US006233845B1

(12) United States Patent
Belli

(10) Patent No.: US 6,233,845 B1
(45) Date of Patent: May 22, 2001

(54) SKATE WITH IMPROVED COMFORT

(75) Inventor: Nicola Belli, Marghera (IT)

(73) Assignee: Benetton Group S.p.A., Ponzano Veneto (IT)

( * ) Notice: Subject to any disclaimer, the term of this patent is extended or adjusted under 35 U.S.C. 154(b) by 0 days.

(21) Appl. No.: 09/446,146

(22) PCT Filed: Jul. 1, 1998

(86) PCT No.: PCT/EP98/04059

§ 371 Date: Dec. 15, 1999

§ 102(e) Date: Dec. 15, 1999

(87) PCT Pub. No.: WO99/02055

PCT Pub. Date: Jan. 21, 1999

(30) Foreign Application Priority Data

Jul. 8, 1997 (IT) ..... TV97A0090

(51) Int. Cl.[7] ..... A43B 7/06

(52) U.S. Cl. ..... 36/3 A; 36/88; 36/93; 36/2.6

(58) Field of Search ..... 36/3 A, 88, 93, 36/2.6

(56) References Cited

U.S. PATENT DOCUMENTS

| | | | | |
|---|---|---|---|---|
| 4,856,294 | * | 8/1989 | Scaringe et al. | 62/259.3 |
| 4,894,931 | * | 1/1990 | Senee et al. | 36/2.6 |
| 5,357,695 | * | 10/1994 | Lu | 36/3 A |
| 5,797,610 | * | 8/1998 | Grande et al. | 280/11.202 |
| 5,985,383 | * | 11/1999 | Allen et al. | 428/34.1 |
| 6,004,662 | * | 12/1999 | Buckley | 428/304.4 |

FOREIGN PATENT DOCUMENTS

| | | | | |
|---|---|---|---|---|
| WO 94/07386 | * | 4/1994 | (WO) | 36/93 |

* cited by examiner

*Primary Examiner*—Paul T. Sewell
*Assistant Examiner*—Troy Arnold
(74) *Attorney, Agent, or Firm*—Guido Modiano; Albert Josif; Daniel O'Byrne

(57) ABSTRACT

A skate with improved comfort, comprising a frame for supporting two or more wheels, with which a shoe is associated. The shoe has openings which are connected to the outside or to a vapor-permeable surface, and an innerboot, or upper, which comprises a phase-change material that releases or absorbs heat in preset temperature ranges.

12 Claims, 4 Drawing Sheets

SKATE WITH IMPROVED COMFORT

BACKGROUND OF THE INVENTION

The present invention relates to a skate with improved comfort.

Conventional skates are currently constituted by a shell whereto a quarter is articulated. These skates are usually made of plastics, and a soft innerboot is arranged inside them. A frame for supporting two or more wheels is associated below the shell.

A problem strongly felt by users relates to the dissipation of the heat produced by the foot during sports practice, which usually occurs in case of favorable weather and therefore on predominantly dry surfaces. This has allowed the development of this sport in warmer countries, where the ideal skating conditions last for a considerable time.

The need to use a rigid shell arises from the fact that the shell must on the one hand secure the foot in an optimum manner and on the other hand allow optimum transmission of forces from the foot to the wheels.

This conventional construction, however, clashes with the need to ventilate the foot in order to dissipate the heat produced in excess. U.S. Pat. 5,171,033 discloses a skate with in-line wheels which is composed of a shell and a cuff which are substantially rigid but have holes or openings that allow ventilation of the underlying innerboot and therefore of the foot contained therein.

However, since the closure devices must allow optimum fastening of the shell on the innerboot, the innerboot usually has a certain thickness, required to allow good foot comfort, and therefore ventilation of part of its outer surface does not allow adequate dissipation of the heat generated by the foot.

The thickness of the innerboot, the material it is made of and the fact that the holes or openings cover only a limited region of the shoe further produce, for the foot, regions at differentiated temperatures.

Moreover, there are times during sports practice when the user reduces his speed and therefore the amount of air flowing by the holes or openings decreases and therefore the ventilation effect and the dissipation of the heat produced by the foot also decrease.

SUMMARY OF THE INVENTION

The aim of the present invention is to solve the above-mentioned problem, eliminating the drawbacks of the cited prior art, by providing a skate which allows both to achieve optimum control, and therefore transmission of forces from the foot to the wheels, and to maintain a good comfort level for the user, keeping the temperature of the foot in optimum conditions.

An important object of the present invention is to provide a skate which allows to maintain a temperature which is uniform over the entire surface of the foot.

A further important object of the present invention is to provide a skate in which it is possible to preset the optimum temperature to be maintained for the foot during sports practice, as a function of specific commercial requirements such as, for example, the targeting of the product to children or adults or to a user who uses it for competitions.

A further object of the present invention is to provide a skate which is structurally simple and effective and can be obtained by using conventional machines and equipment.

This aim, these objects and others which will become apparent hereinafter are achieved by a skate with improved comfort, comprising a shoe characterized in that it comprises openings which are connected to the outside or to a vapor-permeable surface, and an innerboot or upper which comprises a phase-change material that releases or absorbs heat in selected temperature ranges.

BRIEF DESCRIPTION OF THE DRAWINGS

Further characteristics and advantages of the skate according to the present invention will become apparent from the following detailed description of two particular but not exclusive embodiments thereof, illustrated only by way of non-limitative example in the accompanying drawings, wherein.

DESCRIPTION OF THE PREFERRED EMBODIMENTS

Figure 1:
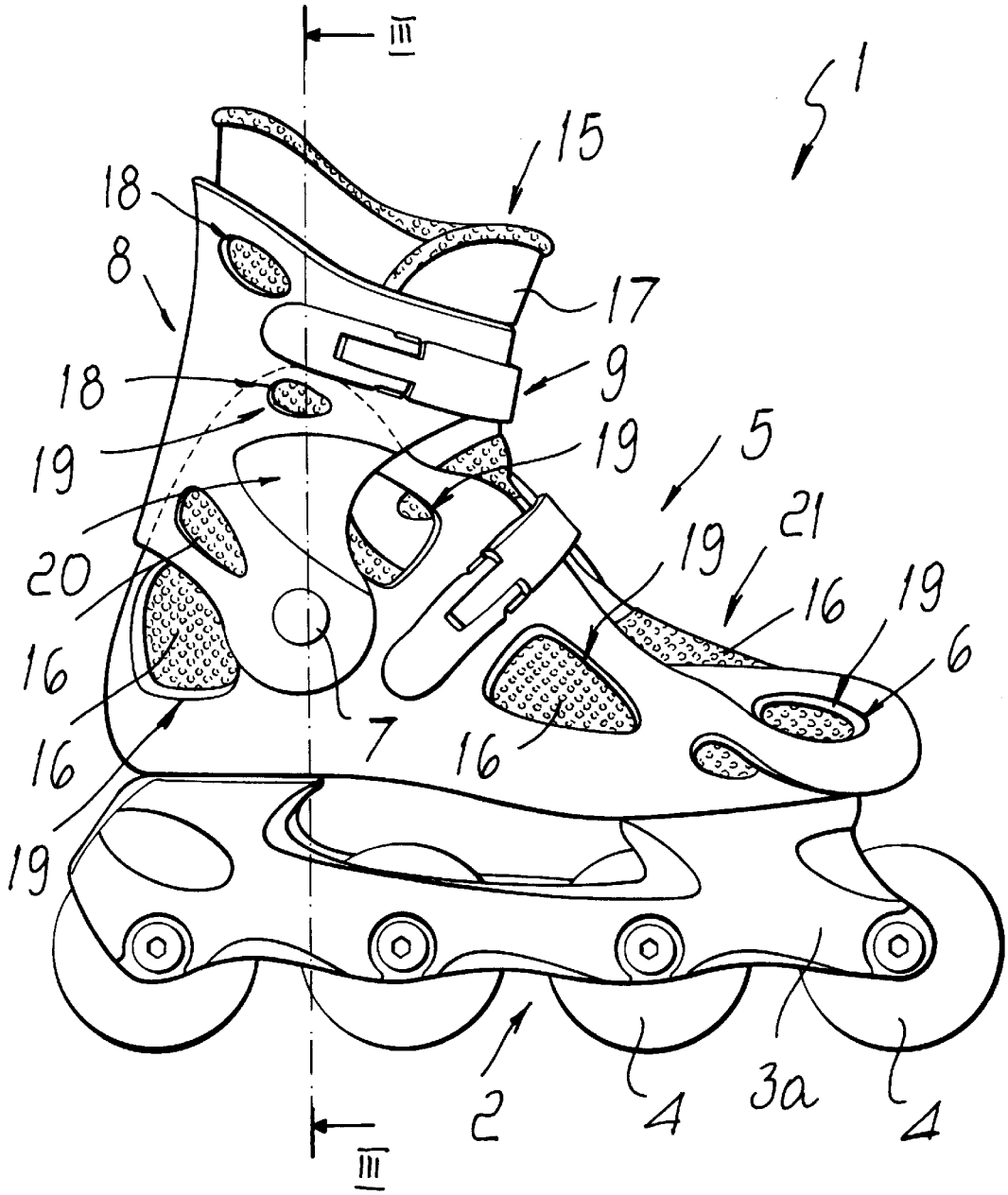
FIG. 1 is a side view of the skate.
Figure 2:
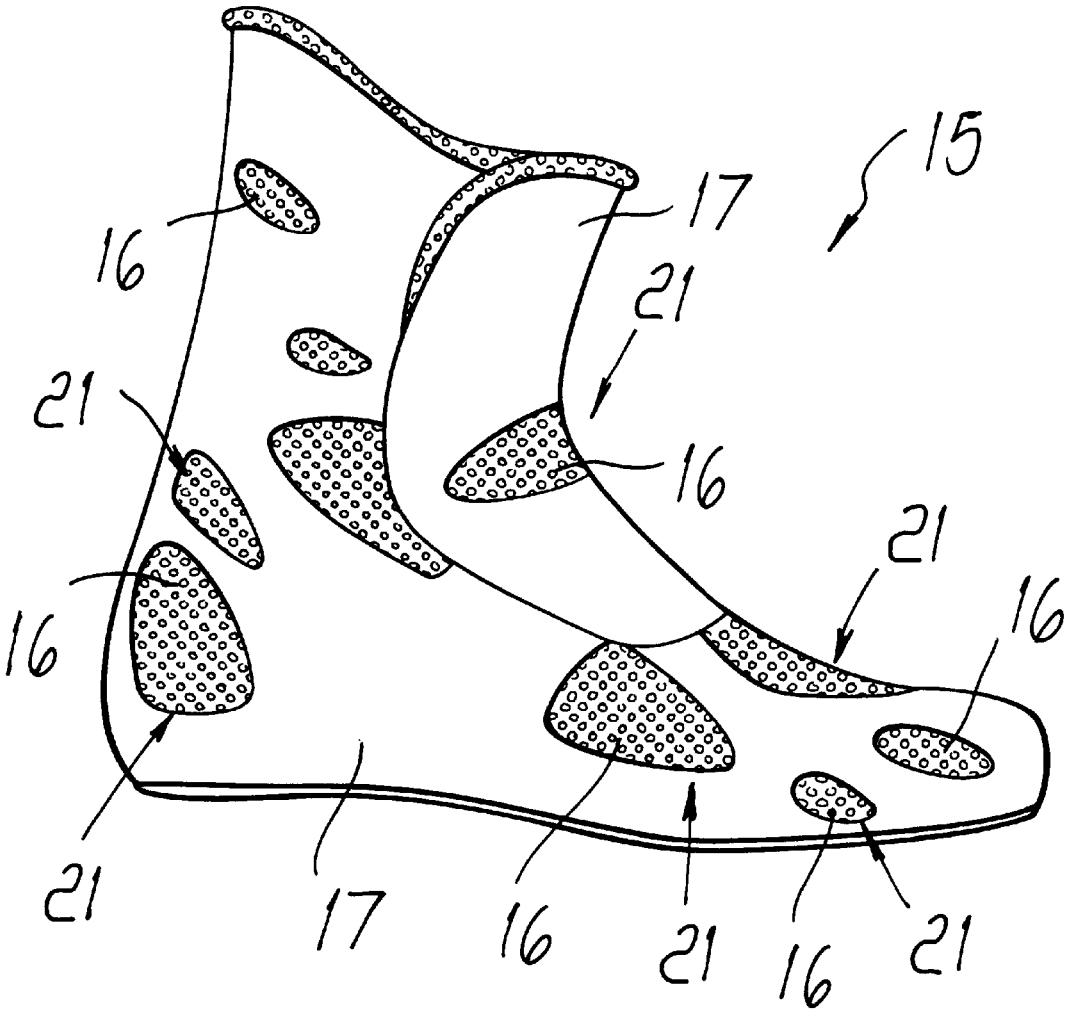
FIG. 2 is a side view of an innerboot.
Figure 3:
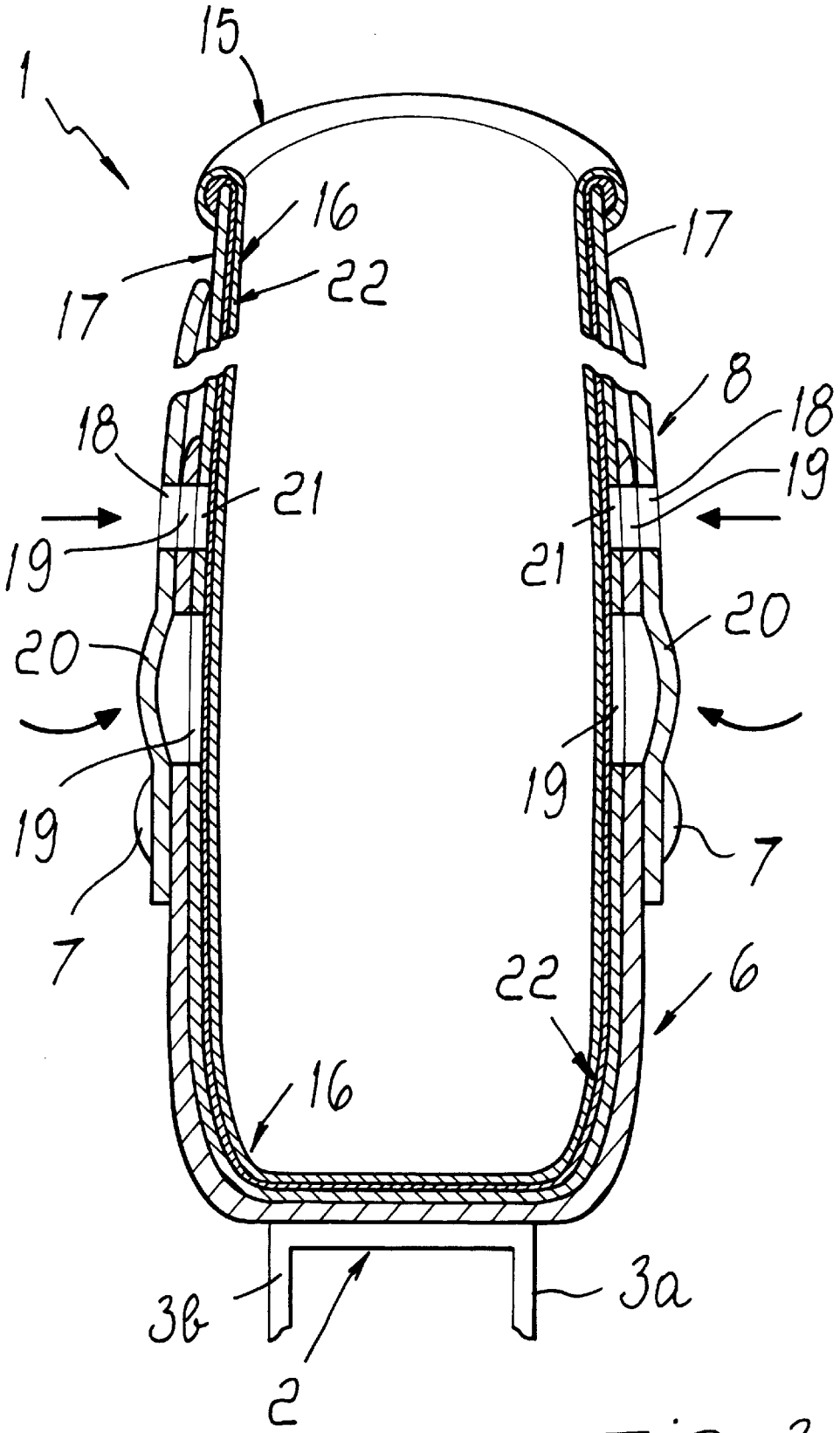
FIG. 3 is a sectional view, taken along the plane III—III of FIG. 1.

With reference to the above figures, the reference numeral 1 designates a skate which comprises a frame 2, which is usually shaped like an inverted U between the wings 3*a* and 3*b* whereof two or more wheels 4 are freely pivoted and arranged mutually in-line.

A shoe or boot 5 is associated in an upward region with respect to the frame 2 and is constituted, as shown in FIG. 1, by a shell 6, which is made of plastics and whereto a cuff 8, also made of plastics, is optionally articulated by means of suitable lateral studs 7. The cuff and the shell are mutually fastened by using conventional fastening devices 9 such as for example levers.

Figure 4:
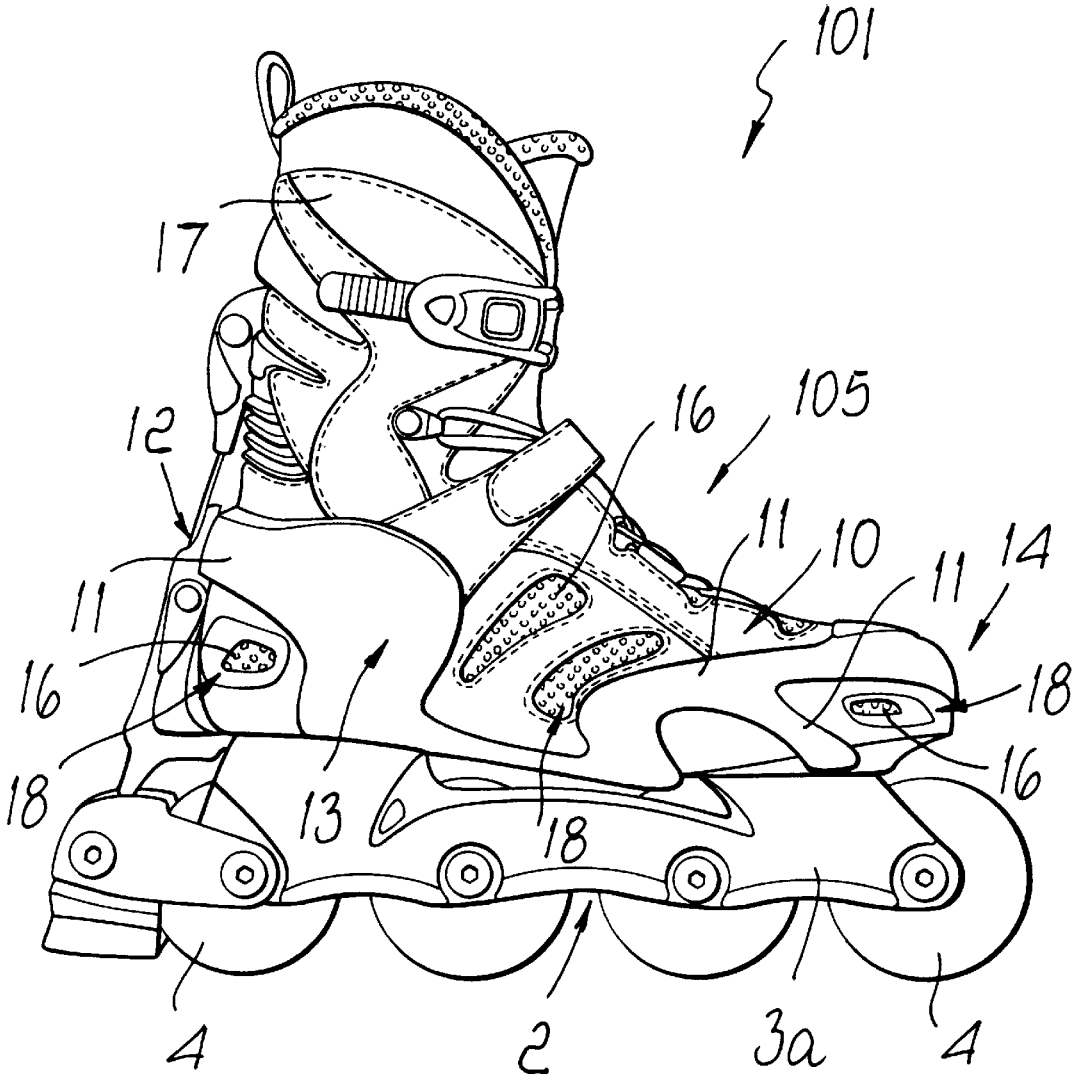
FIG. 4 is a view, similar to FIG. 1, of a second embodiment.

As an alternative, as shown in FIG. 4, the skate 101 has a shoe or boot 105 constituted by an upper 10, which is made of soft material and is therefore used for example for leisure, and on the outside whereof one or more rigid extensions 11 are associated. The extensions preferably affect the heel region 12, the malleolar region 13, and the region 14 of the tip of the foot, so as to achieve optimum transmission of forces to the underlying wheels.

In the embodiment shown in FIG. 1, a soft innerboot 15 is arranged inside the shell 6 and the cuff 8.

Both the innerboot 15 and the upper 10 have an inner lining 16 and an outer lining 17; in the case of the innerboot 15, a padding 22 is interposed between the inner lining 16 and the outer lining 17.

In the embodiment shown in FIG. 1, the shell 6 and the cuff 8 are provided with first through holes or openings 18 and with second through holes or openings 19 which advantageously have the same configuration and arrangement if the cuff and the shell overlap.

Advantageously, protrusions 20 are formed laterally to the cuff 8, in the region above the studs 7, and form a duct for the air at underlying holes or openings 19 formed in the shell.

In the embodiment shown in FIG. 1, on the outer lining 17 of the innerboot 15, and optionally on the padding 22, at the first and/or second holes or openings, third holes or openings 21 are provided which allow to connect the inner lining 16 to the outside.

Advantageously, at the third holes or openings 21 it is possible to associate, inside the outer lining 17, a fabric which is of the mesh type or is in any case suitable to facilitate transpiration.

In the embodiment shown in FIG. 4, in the upper 10, and particularly is in the outer lining 17, first holes or openings 18 are provided which connect the inner lining 16 to the outside; also in this case, it is possible to internally associate a mesh or vapor-permeable fabric with the outer lining 17 at the holes or openings 18.

The innerboot 15, or the upper 10, comprises a fabric or fiber combined in various manners with a chemical compound that releases or absorbs heat in selected temperature ranges, also known as phase-change materials. A material having these features is marketed under the trade-name "Outlast" by the American company Outlast Technology Inc.

Said material is characterized by a high temperature control capability and by high heat conductivity. The material is capable of absorbing and releasing heat to a second body at a selected temperature, which depends on the characteristics of the components used in production, by modifying its chemical state from liquid to crystalline and vice-versa.

It is thus possible to use a fabric with materials which release and absorb heat in very specific temperature ranges, for example between 28° C. and 35° C. or other chosen temperature ranges.

In the specific case, the inner lining 16 can comprise fibers made of said material or can be spread, preferably on the side lying away from the foot, with a layer of the same material which has a temperature range between 28° C. and 35° C., corresponding to a temperature range providing the best comfort for the body.

28° C. is the temperature below which the first feeling of cold is perceived, while 35° C. is the temperature above which the foot begins to perspire.

The first temperature control property of the inner lining becomes active when, during sports practice, the temperature of the foot leaves the range of the above temperature values and thus, for example, when the foot reaches a temperature of 35° C. In this case, all the excess heat is absorbed by the phase-change material associated with the inner lining 16, which thus allows to keep the temperature of the foot constant.

In the opposite case, and therefore when for example the temperature of the foot drops below the threshold of 28° C., the phase-change material associated with the inner lining 16 releases the heat absorbed earlier, thus heating the foot.

The presence of the first, second or third holes or openings formed in the shoe 5 allows to keep the temperature of the inner lining 16 or of the padding 22 of the innerboot at a lower value than the foot, generating a flow of heat from the foot towards the outside of the padding, using the phase-change material as a heat sink.

The second heat conductivity property allows to effectively and quickly diffuse the feeling of comfort from the ventilated regions also to the regions where ventilation is not possible, for example in the region for the mutual pivoting of the shell and of the cuff, in a lateral band of the shell and in general in all those regions where the presence of a rigid or semirigid structure is most necessary in order to allow optimum securing of the foot and transmission of forces to the wheels.

The presence of the holes or openings in the shoe and the use of an inner lining made of phase-change material thus allow to achieve the intended aim and objects, since by means of an effective ventilation the temperature of the foot inside the skate is maintained at all times within the maximum-comfort range throughout the period of use of the skate.

The skate according to the invention is of course susceptible of numerous modifications and variations, all of which are within the scope of the same inventive concept.

The materials and the dimensions constituting the individual components of the skate may of course also be the most pertinent according to specific requirements.

Thus, for example, the inner lining 16 can be made of a phase-change material in which the temperature range is different from the above-mentioned one, and said range can be chosen for example as a function of the particular average climate of the country or of the fact that the skate is used by children or adults or by people practicing competitive sports.

The phase-change material may also be associated, by embedding in fibers or by spreading in layers, also with the outer lining 17 and optionally with the padding 22.

Advantageously, the temperature ranges can be different within he same shoe, in order to achieve the best comfort conditions.

What is claimed is:

1. A skate with improved comfort, comprising:

a fame with wheels pivoted to said frame;

a boot connected above said frame, said boot having a rind outer shell and a soft innerboot or upper arranged inside said shell, said boot having openings arranged between rigid portions of said shell, said innerboot or upper comprising an inner lining and an outer lining which are mutually attached to form said innerboot or upper, said inner lining of said innerboot or upper comprising a phase-change material that releases or absorbs heat in selected temperature ranges, and said outer lining comprising openings therein such that said inner lining is exposed to an outside environment at said openings of said outer lining, said openings of said outer lining being arranged at said openings between said rigid portions of said shell.

2. The skate according to claim 1, further comprising a rigid cuff articulated by means of lateral studs to said shell, said soft innerboot being arranged inside said shell and said cuff, said cuff having openings which overlap selected ones of said openings arranged between rigid portions of said shell.

3. The skate according to claim 2, further comprising protrusions of said cuff formed in a region above said studs laterally to said cuff and forming a duct for air at underlying openings of said openings arranged between rigid portions of said shell.

4. The skate according to claim 2, wherein said soft innerboot further comprises a padding arranged between said inner lining and said outer lining, said openings in said outer lining extending also in said padding of said innerboot to expose said inner lining to the outside environment.

5. The skate according to claim 1, wherein said rigid portions comprise one or more rigid extensions arranged at regions of a heel, of malleoli and of a tip of a foot.

6. The skate according to claim 1, wherein said phase-change material releases or absorbs heat in said selected temperature ranges by modifying a chemical state thereof from liquid to crystalline and viceversa.

7. The skate according to claim 6, wherein said phase-change material releases and absorbs heat between 28° C. and 35° C.

8. The skate according to claim 1, further comprising a fabric adapted to facilitate transpiration arranged at said outer lining at said openings arranged between said rigid portions of said shell.

9. The skate according to claim 1, wherein said phase-change material is embedded in fibers of said inner lining.

10. The skate according to claim 1, wherein said phase-change material is a spread layer of said inner lining.

11. A skate with improved comfort, comprising;

a frame with wheels pivoted to said frame;

a boot connected above said frame;

a rigid shell of said boot;

openings of said boot arranged between rigid portions of said rigid shell;

a soft innerboot of said boot arranged inside said rigid shell, said soft innerboot comprising an inner lining and an outer lining which are mutually attached to form said soft innerboot, said inner lining of said soft innerboot comprising a phase-change material that releases or absorbs heat in selected temperature ranges, and said outer lining comprising opens therein such that said inner lining is exposed to an outside environment at said openings of said outer lining, said openings of said outer lining being arranged at said openings between said rigid portions of said rigid shell.

12. A skate with improved comfort, comprising:

a frame with wheels pivoted to said frame;

a boot connected above said frame;

rigid extensions of said boot;

openings of said boot arranged between said rigid extensions of said boot;

a soft upper of said boot arranged inside said rigid extensions of said boot, said soft upper comprising an inner lining and an outer lining which are mutually attached to form said soft upper, said inner lining of said soft upper comprising a phase-change material that releases or absorbs heat in selected temperature ranges, and said outer lining comprising openings therein such that said inner lining is exposed to an outside environment at said openings of said outer lining, said openings of said outer lining being arranged at said openings arranged between said rigid extensions of said boot.

* * * * *